US007434924B2

(12) United States Patent
Lee et al.

(10) Patent No.: US 7,434,924 B2
(45) Date of Patent: Oct. 14, 2008

(54) INK CARTRIDGE AND WET-TYPE ELECTROPHOTOGRAPHIC IMAGE FORMING APPARATUS HAVING THE SAME

(75) Inventors: Seung-yoon Lee, Suwon-si (KR); Myoung-chan Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 339 days.

(21) Appl. No.: 11/200,175

(22) Filed: Aug. 10, 2005

(65) Prior Publication Data

US 2006/0033787 A1 Feb. 16, 2006

(30) Foreign Application Priority Data

Aug. 14, 2004 (KR) ..... 10-2004-0064113

(51) Int. Cl.
*B41J 2/175* (2006.01)

(52) U.S. Cl. ..... 347/86; 347/85

(58) Field of Classification Search ..... 347/86, 347/85; 15/257.075; 399/120, 238, 12
See application file for complete search history.

(56) References Cited

U.S. PATENT DOCUMENTS 2,157,512 A * 5/1939 Watt ..... 15/257.075
5,396,316 A * 3/1995 Smith ..... 399/120
5,655,194 A * 8/1997 Landa et al. ..... 399/238
5,970,273 A * 10/1999 Zenk et al. ..... 399/12
6,032,010 A 2/2000 Kim et al.
6,249,655 B1 * 6/2001 Baek et al. ..... 399/12
2004/0091287 A1 * 5/2004 Matsumoto et al. ..... 399/258
2004/0146319 A1 * 7/2004 Sudo et al. ..... 399/258
2006/0034640 A1 * 2/2006 Kim et al. ..... 399/238

FOREIGN PATENT DOCUMENTS

KR 10-2000-0032859 A 6/2000
KR 10-2000-0060356 A 10/2000
KR 10-0350982 8/2001

* cited by examiner

*Primary Examiner*—Stephen D. Meier
*Assistant Examiner*—Carlos A Martinez, Jr.
(74) *Attorney, Agent, or Firm*—Roylance, Abrams, Berdo & Goodman, LLP

(57) ABSTRACT

An ink cartridge and a wet-type electrophotographic image forming apparatus having the ink cartridge, wherein the ink cartridge is detachably mounted with respect to an image forming apparatus body and supplies a developing unit with ink. The ink cartridge includes a housing including an inflow inlet into which the ink flows, and an inflow inlet opening and closing unit for operating together with the image forming apparatus body such that when the housing is mounted in the image forming apparatus body the inflow inlet is opened, and when the housing is removed from the image forming apparatus body the inflow inlet is closed. The inflow inlet opening and closing unit includes a moving member installed in the housing so as to move in first and second directions, at least one expanding tube bag installed in the inflow inlet for expanding and/or shrinking, depending on an inflow amount of liquid, to open and/or close the inflow inlet, and a liquid feeding unit for selectively feeding the liquid to and withdrawing the liquid from the at least one expanding tube bag depending on a movement direction of the moving member.

10 Claims, 5 Drawing Sheets

INK CARTRIDGE AND WET-TYPE ELECTROPHOTOGRAPHIC IMAGE FORMING APPARATUS HAVING THE SAME

CROSS-REFERENCE TO RELATED APPLICATIONS

This application claims the benefit under 35 U.S.C. §119 (a) of Korean Patent Application No. 10-2004-0064113, filed in the Korean Intellectual Property Office on Aug. 14, 2004, the entire disclosure of which is hereby incorporated by reference.

BACKGROUND OF THE INVENTION

1. Field of the Invention

The present invention relates to a wet-type image forming apparatus using a liquid developer. More particularly, the present invention relates to an ink cartridge for feeding an ink to a developing unit or for withdrawing the ink from the developing unit, and a wet-type electrophotographic image forming apparatus having the same.

2. Description of the Related Art

In general, image forming apparatuses can be classified into dry-type image forming apparatuses using a powdered dry developer, and wet-type image forming apparatuses using a liquid wet developer. The dry-type and wet-type image forming apparatuses each have their own advantages. However, the wet-type image forming apparatuses can obtain a clearer, higher resolution printed material than the dry-type image forming apparatuses. In particular, with the increasing popularization of digital cameras, such a clearer, high quality natural color printed material is required. Thus, color image forming apparatuses have been increasingly demanded.

However, in such a wet-type image forming apparatus, a much larger amount of developer than necessary for substantial printing must be fed to a developing unit performing a developing process to obtain satisfactory printing quality. Thus, developer that is not used in printing is withdrawn to an ink cartridge.

FIG. 1 is a schematic view of a conventional wet-type electrophotographic image forming apparatus for performing such an ink withdrawing process. As shown in FIG. 1, the wet-type electrophotographic image forming apparatus includes developing units 16 including photosensitive bodies 12, ink cartridges 15 for feeding ink to the developing units 16 and for withdrawing ink from the developing units 16, and fitting units 20 for coupling the developing units 16 and the ink cartridges 15. Reference numeral 18 denotes an intermediate transfer belt, and reference numeral 17 denotes transfer backup rollers for supporting the intermediate transfer belt 18 so as to transfer the images from the photosensitive bodies 12 to the intermediate transfer belt 18. Reference character P denotes a paper transferring path.

The fitting units 20 include coupling tubes 25 for forming flow paths for the ink, nut and bolt fitting portions 21 and 22 for coupling the developing units 16 and the coupling tubes 25, nut and bolt fitting portions 23 and 24 for coupling the ink cartridges 15 and the coupling tubes 25, and withdrawing pumps 26.

A process of circulating the ink in the wet-type electrophotographic image forming apparatus having the above-described structure will now be described in greater detail. After the ink cartridges 15 and the developing units 16 are mounted in the wet-type electrophotographic image forming apparatus, the nut and bolt fitting portions 21, 22, 23, and 24 are combined between the ink cartridges 15 and the fitting units 20, and between the developing units 16 and the fitting units 20. Thereafter, when a printing command is requested, the ink is fed from the ink cartridges 15 to the developing units 16 through the feeding pumps (not shown). However, after a predetermined developing process is performed, all the ink may not be used for a printing operation and some ink may remain in the developing units 16. The remaining ink is then withdrawn to the ink cartridges 15 through the withdrawing pumps 26 and the coupling tubes 25.

Coupling apparatuses, therefore, are necessarily required between the developing units 16 and the ink cartridges unit 15 to circulate the wet ink. Also, the airtightness of the coupling apparatuses is very important in terms of the characteristics of the wet ink. In addition, while the ink cartridges 15 containing the ink are being mounted in or withdrawn from an image forming apparatus body, the ink must not flow from the ink cartridges 15. In the above-described coupling and airtightness methods, the coupling apparatuses, such as the bolt fitting portions 22 and 24 and the nut fitting portions 21 and 23, including O-rings and elastic members, are generally well adapted for airtight use with the developing unit 16 and the ink cartridge 15.

However, the above-mentioned coupling apparatuses include additional power sources such as pumps and other nut and bolt fitting portions. Thus, the structure of the coupling apparatuses is complicated and the manufacturing costs for the coupling apparatuses is increased. Moreover, the nut and bolt fitting portions 23 and 24 must be manually combined to couple the fitting units 20 and the ink cartridges 15.

Furthermore, during the ink withdrawing process, the flow paths of the ink between the fitting units 20 and the ink cartridges 15 may be curved, and the area of the flow paths may be suddenly reduced. Thus, the ink may stick to the flow paths. As a result, the flow paths may become clogged, or functions of combining, opening or closing the fitting units 20 may be lost. In particular, this may frequently occur in places where the nut fitting portions 21 and 22 and the bolt fitting portions 23 and 24, are combined. In a case where nut and bolt fitting portions or coupling tubes are clogged, ink may be continuously fed to the developing units 16, but not withdrawn from the developing units. Thus, the ink may overflow in the developing units 16. The overflowing ink may then contaminate various components of the wet-type electrophotographic image forming apparatus. As a result, the wet-type electrophotographic image forming apparatus may not operate. Also, the ink may flow outside the wet-type electrophotographic image forming apparatus. Thus, the surroundings may become seriously contaminated.

Accordingly, a need exists for an ink cartridge system such that efficient and effective ink flow can be maintained, while further maintaining the airtight characteristics of the ink cartridge.

SUMMARY OF THE INVENTION

Accordingly, the present invention has been made to solve the above-mentioned and other problems. An aspect of the present invention is to provide an improved ink cartridge that is capable of maintaining airtightness during an image forming process, as well as when the ink cartridge is being easily mounted in or removed from an image forming apparatus body, and a wet-type electrophotographic image forming apparatus having the same.

According to an aspect of the present invention, an ink cartridge is provided that is detachably mounted with respect to an image forming apparatus body for supplying a developing unit with ink and comprising a housing including an inflow inlet into which the ink flows, and an inflow inlet opening and closing unit for operating together with the image forming apparatus body such that when the housing is mounted with the image forming apparatus body the inflow inlet is opened, and when the housing is removed from the image forming apparatus body the inflow inlet is closed.

The inflow inlet opening and closing unit may include a moving member installed in the housing so as to move in first and second directions, at least one expanding tube bag installed in the inflow inlet for expanding and/or shrinking, depending on an inflow amount of liquid, to open and/or close the inflow inlet, and a liquid feeding unit for selectively feeding the liquid to and withdrawing the liquid from the at least one expanding tube bag depending on a movement direction of the moving member.

The liquid feeding unit may include a bellows coupled to the moving member for storing the liquid, and a liquid transferring pipe for coupling the bellows and the at least one expanding tube bag.

The inflow inlet opening and closing unit may further include an elastic member for elastically pressing the moving member toward the first direction so as to expand the at least one expanding tube bag. When the moving member is mounted in the image forming apparatus body, the moving member may then be moved by the image forming apparatus body in the second direction.

The inflow inlet opening and closing unit may further include a pair of rubber covers installed on an inner wall of the inflow inlet to face each other so as to maintain a closed portion of the inflow inlet independently.

A pair of expanding tube bags may be provided and supported by the pair of rubber covers, respectively, to close a remaining portion of the inflow inlet.

The inflow inlet opening and closing unit may further include a pair of sealing bags installed on an inner circumference of the inflow inlet to face each other and being positioned between the expanding tube bags so as to prevent a gap from being generated between a point at which the expanded tube bags contact each other and contact the inner circumference of the inflow inlet.

A drainpipe may be coupled to the inflow inlet to withdraw the ink used in the developing unit, and a sealing member may be installed in the inflow inlet for sealing between an outer circumference of the drainpipe and an inner circumference of the inflow inlet when the drainpipe is inserted into the inflow inlet.

The sealing member may include a flexible film coupled to the inner circumference of the inflow inlet and comprise a cavity through which the drainpipe passes, and a flexible wire formed at an edge of the cavity of the flexible film to be thicker than the flexible film.

According to another aspect of the present invention, a wet-type electrophotographic image forming apparatus is provided comprising an image forming apparatus body including a developing unit for forming a predetermined image using ink and having an ink cartridge mounting portion, and an ink cartridge that is detachably mounted with respect to the ink cartridge mounting portion and including ink to be fed to the developing unit. The ink cartridge comprises a housing including an inflow inlet to which a drainpipe for withdrawing the ink from the ink cartridge is coupled, and an inflow inlet opening and closing unit for operating together with the ink cartridge mounting portion such that when the housing is mounted in the ink cartridge mounting portion the inflow inlet is opened, and when the housing is removed from the mounting portion the inflow inlet is closed.

The inflow inlet opening and closing unit may include a moving member installed in the housing so as to move in first and second directions and, when being locked in the ink cartridge mounting portion, moves in the second direction, an elastic member for elastically pressing the moving member in the first direction, at least one expanding tube bag installed in the inflow inlet for expanding and/or shrinking depending on an inflow amount of liquid to open and/or close the inflow inlet, and a liquid feeding unit for selectively feeding the liquid to and withdrawing the liquid from the at least one expanding tube bag depending on a movement direction of the moving member.

The at least one expanding tub bag may expand when being fed with the liquid from the liquid feeding unit as the moving member moves in the first direction, and may shrink when returning the liquid to the liquid feeding unit as the moving member moves in the second direction.

BRIEF DESCRIPTION OF THE DRAWINGS

The above aspects and features of the present invention will become more apparent by describing certain embodiments of the present invention with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
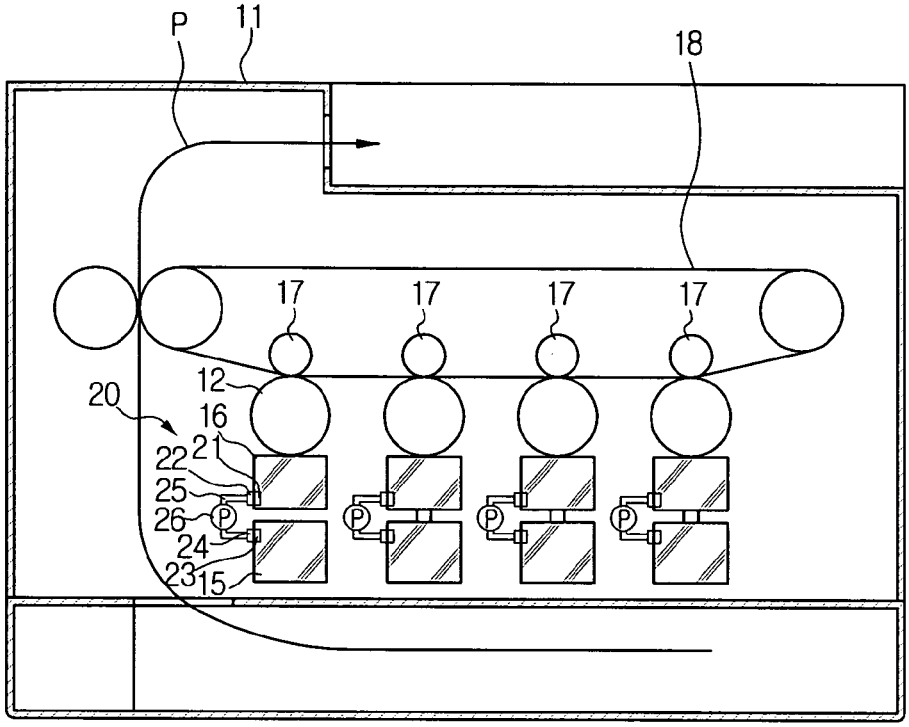
FIG. 1 (PRIOR ART)
FIG. 1 is a schematic view of a conventional wet-type electrophotographic image forming apparatus.

Certain exemplary embodiments of the present invention will now be described in greater detail with reference to the accompanying drawings.

In the following description, same drawing reference numerals are used for the same elements even in different drawings. The matters defined in the description, such as detailed construction and element descriptions, are provided to assist in a comprehensive understanding of the invention. Also, functions or constructions well known to those skilled in the art are omitted for clarity and conciseness.

Hereinafter, an ink cartridge according to an exemplary embodiment of the present invention and a wet-type electrophotographic image forming apparatus having the ink cartridge, will be described in detail with reference to the attached drawings.

Figure 2:
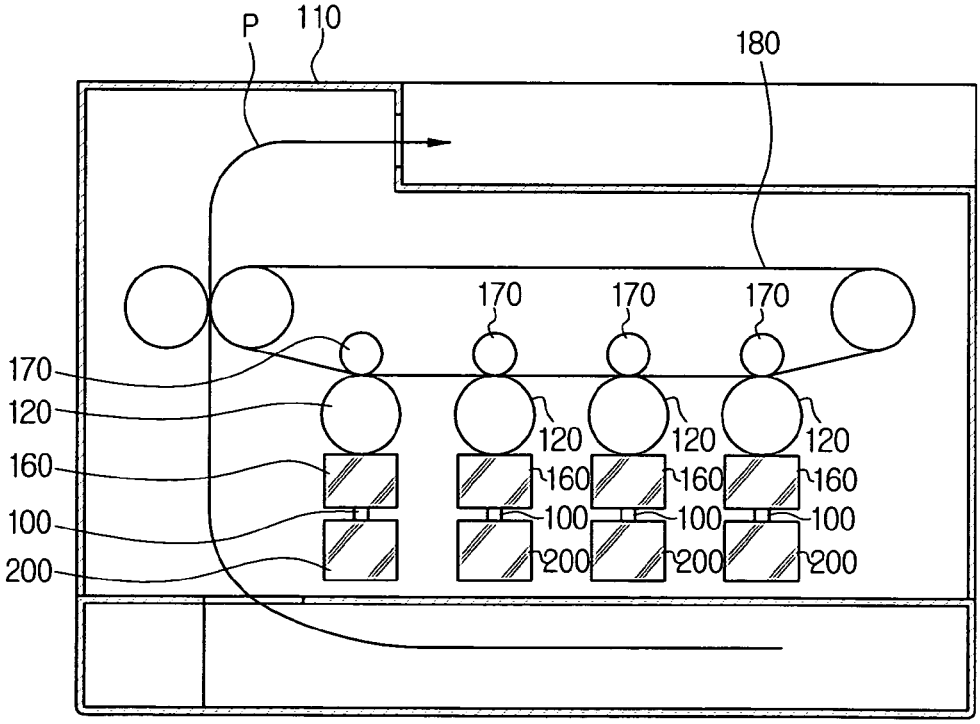
FIG. 2 is a schematic view of a wet-type electrophotographic image forming apparatus according to an embodiment of the present invention.

FIG. 2 is a schematic view of a wet-type electrophotographic image forming apparatus according to an embodiment of the present invention. Referring to FIG. 2, the wet-type electrophotographic image forming apparatus includes an image forming apparatus body 110, a plurality of developing units 160 for feeding photosensitive bodies 120 with ink to form images, a plurality of ink cartridges 200 for storing the ink, and drainpipes 100 for coupling the developing units 160 and the ink cartridges 200, respectively.

Figure 5:
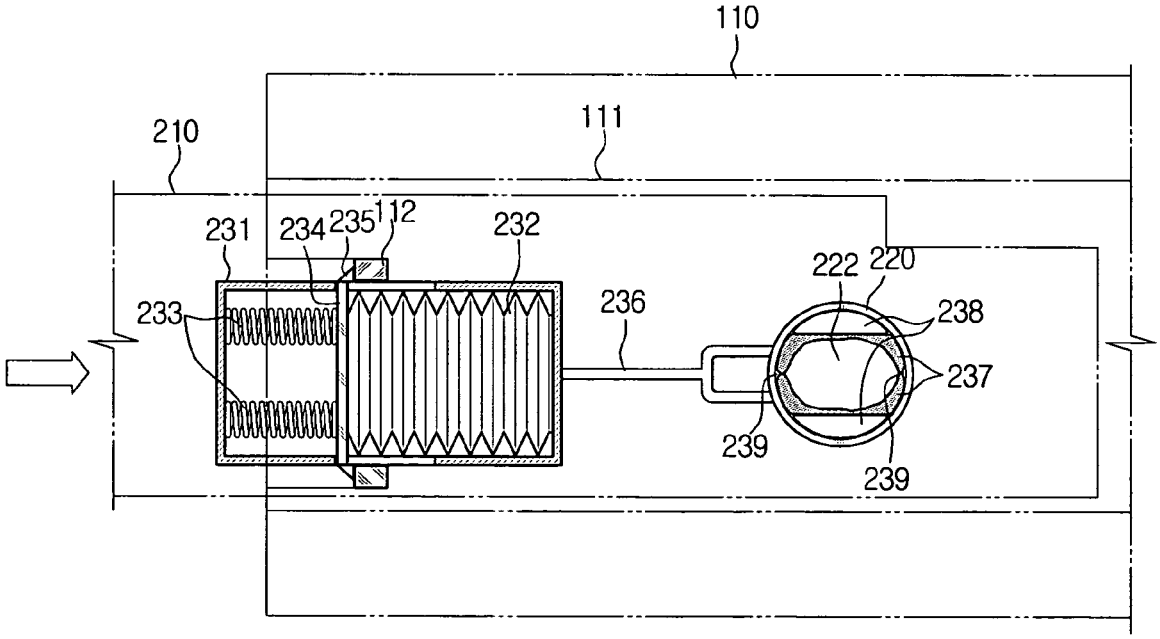
FIG. 5 is a plan view of the ink cartridge of FIG. 3 that is mounted in an image forming apparatus body according to an embodiment of the present invention.

The image forming apparatus body 110 encloses the components of the wet-type electrophotographic image forming apparatus such as the developing units 160, the ink cartridges 200, and the like, and includes a mounting portion 111 as shown in FIG. 5 in which the ink cartridges 200 are mounted.

The developing units 160 are installed above the ink cartridges 200 and transfer the ink to the photosensitive bodies 120 to form the images. The ink fed from the ink cartridges 200 to the developing units 160 serves to form the images on the photosensitive bodies 120, and the remaining ink is withdrawn to the ink cartridges 200.

Reference numeral 180 denotes an intermediate transfer belt, and reference numeral 170 denotes transfer backup rollers for supporting the intermediate transfer belt 180 so as to transfer the images from the photosensitive bodies 120 to the intermediate transfer belt 180. Reference character P denotes a paper transferring path.

The drainpipes 100 are respectively coupled to the developing units 160 and couple the developing units 160 to the ink cartridges 200 when the ink cartridges 200 are mounted in the image forming apparatus body 110. Accordingly, the drainpipes 100 serve as flow paths for the withdrawn ink.

The ink cartridges 200 respectively store and feed different color ink, such as yellow (Y), magenta (M), cyan (C), and black (B) colored ink to the developing units 160, as described in greater detail below.

Figure 3:
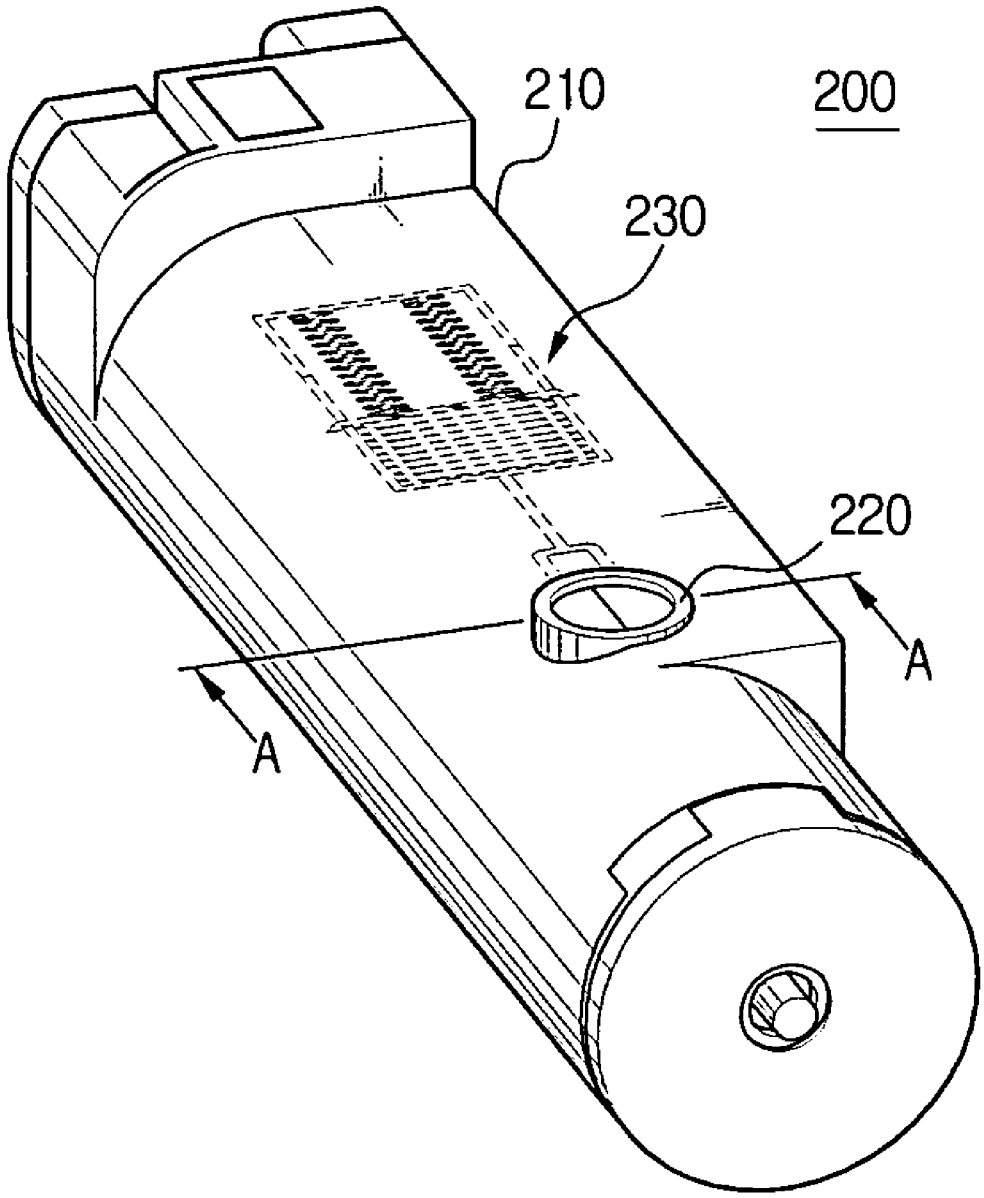
FIG. 3 is a schematic perspective view of an ink cartridge that can be mounted in an image forming apparatus body according to an embodiment of the present invention.
Figure 4:
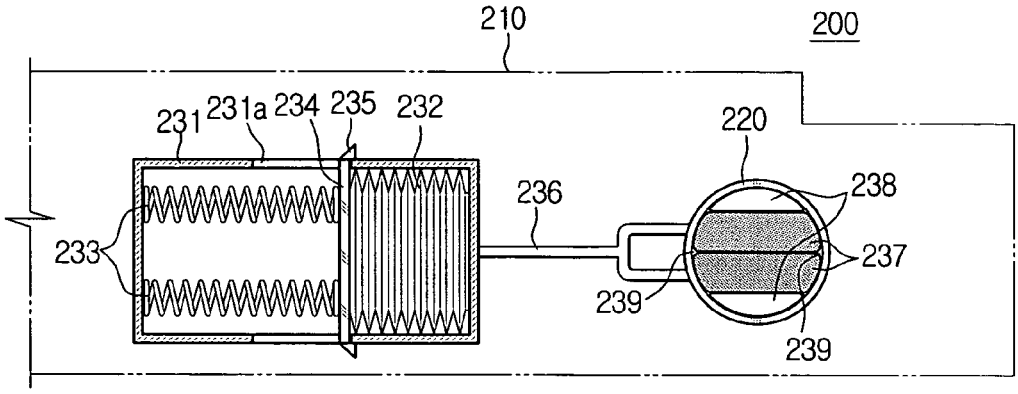
FIG. 4 is a plan view of the ink cartridge shown in FIG. 3.

FIG. 3 is a schematic perspective view of an exemplary ink cartridge 200 that can be mounted in the image forming apparatus body 110 according to an embodiment of the present invention. FIG. 4 is a plan view of the ink cartridge 200 of FIG. 3, and FIG. 5 is a plan view of the ink cartridge 200 of FIG. 3 when mounted in the image forming apparatus body 110 according to an embodiment of the present invention.

The ink cartridge 200 includes a cylinder-shaped housing 210 including a drainpipe inlet 220 which is formed in an upper portion of the ink cartridge 200 and into which the drainpipe 100 is inserted, and a drainpipe inlet opening and closing unit 230 installed inside the housing 210 to open and close the drainpipe inlet 220.

The drainpipe inlet opening and closing unit 230 operates when the ink cartridge 200 is mounted in the image forming apparatus body 110 so as to open the drainpipe inlet 220. The drainpipe inlet opening and closing unit 230 includes a stationary frame 231, a liquid transferring pipe 236, expanding tube bags 237, rubber covers 238, and sealing bags 239. The stationary frame 231 is installed inside the housing 210 and includes a bellows 232, an elastic member 233, and a moving member 234. A guide groove 231*a* is formed in an upper surface of the stationary frame 231 so that the moving member 234 moves along the guide groove 231*a*.

The bellows 232 includes nonvolatile oil or liquid, such as water. The liquid transferring pipe 236 is coupled to an end of the bellows 232 so as to transfer the liquid when the bellows 232 expands or shrinks.

The moving member 234 is coupled to the other end of the bellows 232 and is formed on the stationary frame 231 to move along the guide groove 231*a*. The moving member 234 may protrude outside the housing 210. Protrusions 235 are formed at both ends of the moving member 234. When the ink cartridge 200 is mounted in the mounting portion 111 formed in the image forming apparatus body 110, the protrusions 235 interfere with a locking member 112 formed in the mounting portion 111 (refer to FIG. 5).

Since the elastic member 233 includes an end coupled to the stationary frame 231 and the other end coupled to the moving member 234, the elastic member 233 presses the moving member 234 toward a predetermined direction.

The liquid transferring pipe 236 is coupled to the bellows 232 and the expanding tube bags 237 so as to transfer liquid between each. In an exemplary embodiment shown, since two expanding tube bags 237 are installed, the liquid transferring pipe 236 includes two liquid paths branched therefrom. In yet other embodiments of the present invention, the number of expanding tube bags and liquid paths can be varied as required by the application.

The expanding tube bags 237 are installed inside the drainpipe inlet 220 and expand or shrink depending on an inflow amount of liquid from the liquid transferring pipe 236 so as to open or close the drainpipe inlet 220. As shown in FIG. 4, the two expanding tube bags 237 may face each other. The liquid transferring pipe 236 is coupled to the expanding tube bags 237. Thus, when the liquid flows into the expanding tube bags 237 through the liquid transferring pipe 236, the expanding tube bags 237 expand to close the drainpipe inlet 220 (see FIG. 4). When the liquid flows from the expanding tube bags 237, the expanding tube bags 237 shrink to open the drainpipe inlet 220 (see FIG. 5). Accordingly, the expanding tube bags 237 may be formed of any suitable elastic material.

The rubber covers 238 are installed on an inner wall of the drainpipe inlet 220 to face each other and respectively support the expanding tube bags 237. The rubber covers 238 include liquid or gas, such as air, so as to maintain a predetermined volume. Thus, the rubber covers 238 maintain a closed portion of the drainpipe inlet 220 independently, such that the expanding tube bags 237 can rapidly open or close the remaining drainpipe inlet 220 opening depending upon the expanding or shrinking of the expanding tube bags 237.

The sealing bags 239 are installed on the inner wall of the drainpipe inlet 220 to face each other. The sealing bags 239 serve to fill a gap formed at an inner circumference of the drainpipe inlet 220 between the expanding tube bags 237 when the expanding tube bags 237 expand and contact each other to close the drainpipe inlet 220. The drainpipe inlet 220 is circular. Thus, although the expanding tube bags 237 uniformly expand, the gap is formed in the drainpipe inlet 220. However, the sealing bags 239 prevent the gap from being formed in the drainpipe inlet 220.

Figure 6A:
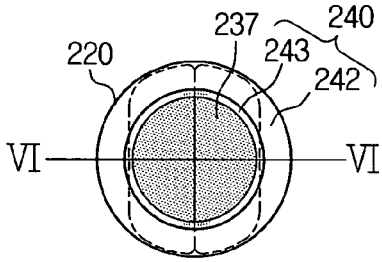
FIGS. 6A to 7B are plan views of an inflow inlet of the ink cartridge of FIG. 3 in which a sealing member is installed and cross-sectional views of the inflow inlet according to an embodiment of the present invention.
Figure 6B:
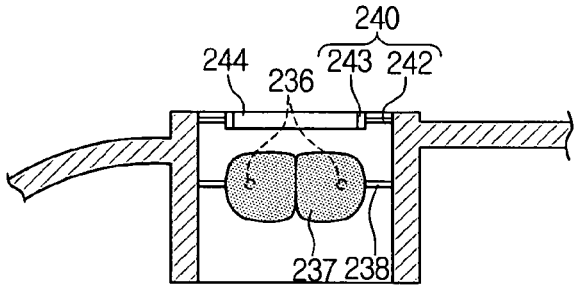
Figure 7A:
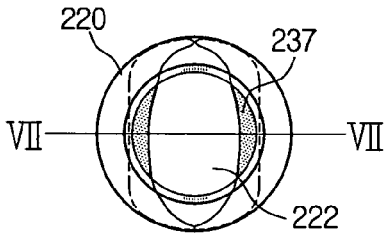
Figure 7B:
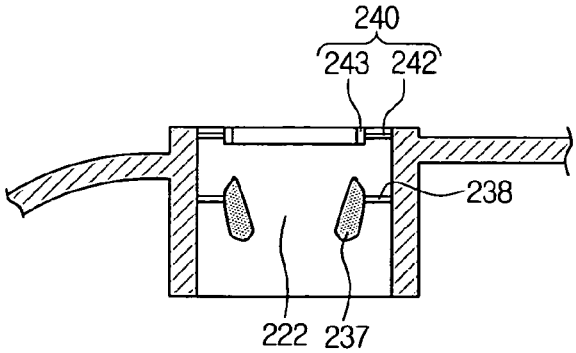

A sealing member 240 is further installed on the expanding tube bags 237 in the drainpipe inlet 220. This is more clearly shown in FIGS. 6A to 7B. FIG. 6A illustrates a plan view of the drainpipe inlet 220 in which a sealing member 240 is installed when the ink cartridge 200 is not mounted in the image forming apparatus body 110, and FIG. 6B illustrates a cross-sectional view of the drainpipe inlet 220, taken along line VI-VI of FIG. 6A. FIG. 7A illustrates a plan view of the drainpipe inlet 220 in which the sealing member 240 is installed when the ink cartridge 200 is mounted in the image forming apparatus body 110, and FIG. 7B illustrates a cross-sectional view of the drainpipe inlet 220, taken along line VII-VII of FIG. 7A.

Figure 8:
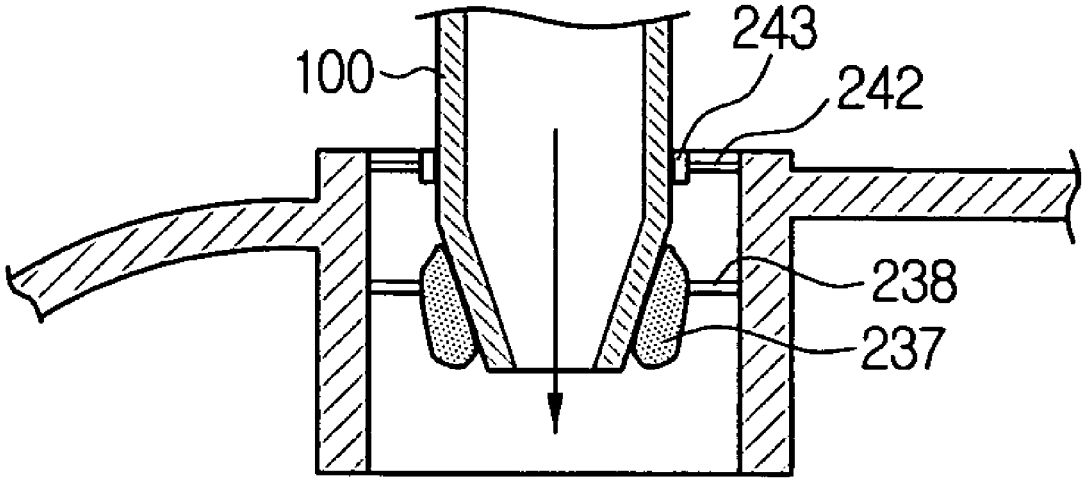
FIG. 8 is a cross-sectional view of the inflow inlet of FIG. 7 to which a drainpipe is coupled according to an embodiment of the present invention.

The sealing member 240 serves to seal the opening between an outer circumference of the drainpipe 100 shown in FIG. 8, and an inner circumference of the drainpipe inlet 220 when the drainpipe 100 is coupled to the drainpipe inlet 220, and includes a flexible film 242 and a flexible wire 243.

The flexible film 242 is coupled to the inner circumference of the drainpipe inlet 220 and includes a cavity 244 through which the drainpipe 100 passes. The flexible wire 243 is thicker than the flexible film 242, and is formed at the edge of the flexible film 242. The flexible wire 243 may be elastically formed. Referring to FIG. 8, the drainpipe 100 is inserted into the drainpipe inlet 220 of FIG. 7B and the cavity 244 of the flexible film 242. The flexible wire 243 serves to prevent the ink inside the ink cartridge 200 from flowing out of the ink cartridge 200.

The operation of the ink cartridge 200 will now be described in greater detail with reference to FIGS. 3 through 8.

Referring to FIGS. 4 and 6B, when the ink cartridge 200 is not mounted in the image forming apparatus body 110, the moving member 234 is pressed by an elastic force of the elastic member 233. The liquid in the bellows 232 is compressed and flows into the expanding tube bags 237 through the liquid transferring pipe 236 so as to expand the expanding tube bags 237. As a result of the expanding tube bags 237 and cooperating rubber covers 238 and sealing bags 239, the drainpipe inlet 220 of the ink cartridge 200 is closed so that the ink in the ink cartridge 200 cannot flow out.

Referring to FIGS. 5 and 7B, when the ink cartridge 200 is mounted in the mounting portion 111 of the image forming apparatus body 110 in the direction indicated by the arrow, the protrusions 235 of the moving member 234 are locked by the locking member 112 installed in the mounting portion 111. Since the ink cartridge 200 continuously advances in the direction indicated by the arrow, the bellows 232 are expanded in an opposite direction relative to the direction along which the ink cartridge 200 is mounted. The liquid in the expanding tube bags 237 flows from the expanding tube bags 237 due to the expanding of the bellows 232, and then flows into the bellows 232 through the liquid transferring pipe 236. As a result, the expanding tube bags 237 shrink, and thus, a drainpipe entry path 222 is formed between the expanding tube bags 237.

Referring to FIG. 8, when the ink cartridge 200 is completely mounted in the image forming apparatus body 110, the drainpipe 100 coupled to the developing unit 160 shown in FIG. 2 descends from the developing unit 160 and is inserted into the ink cartridge 200 through the drainpipe inlet 220 of the ink cartridge 200. As a result, the ink in the developing unit 160 is withdrawn from the developing unit 160 into the ink cartridge 200 through the drainpipe 100 along a direction indicated by the arrow.

As described above, an ink cartridge and a wet-type electrophotographic image forming apparatus having the ink cartridge can be provided according to the present invention such that when the ink cartridge is not mounted in the image forming apparatus body, an ink inflow inlet can be automatically closed and sealed. When the ink cartridge is mounted in the image forming apparatus body, the inflow inlet can be automatically opened while maintaining the airtight characteristics of the ink cartridge using a sealing member.

Also, when the ink cartridge is mounted in or removed from the image forming apparatus body, the inflow inlet can be automatically opened or closed in response. Thus, the ink cartridge can be conveniently mounted in the image forming apparatus body. Also, when the ink cartridge is coupled to a drainpipe of a developing unit, an inflow path can be provided that will not suddenly shrink or expand. Therefore, the ink will not clog the inflow path of the ink cartridge.

Moreover, a drainpipe inlet can be opened or closed using an oil pressure. Thus, the drainpipe inlet can be opened or closed regardless of any drying or sticking of the ink on the surfaces of expanding tube bags.

The foregoing embodiments and advantages are merely exemplary, and are not to be construed as limiting the present invention. The present teaching can be readily applied to other types of apparatuses. Also, the descriptions of the embodiments of the present invention are intended to be illustrative, and not to limit the scope of the claims, and many alternatives, modifications, and variations will be apparent to those skilled in the art.

What is claimed is:

1. An ink cartridge detachably mounted with respect to an image forming apparatus body and supplying a developing unit with ink, comprising:

a housing comprising an inflow inlet into which ink flows; and an inflow inlet opening and closing unit for operating together with the image forming apparatus body such that when the housing is mounted in the image forming apparatus body a center portion of the inflow inlet is opened and a remaining portion of the inflow inlet remains closed, wherein the inflow inlet opening and closing unit comprises:

a moving member installed in the housing so as to move in first and second directions;

at least one expanding tube bag installed in the inflow inlet for expanding and shrinking depending on an inflow amount of liquid to close and open the inflow inlet, respectively; and a liquid feeding unit for selectively feeding the liquid to and withdrawing the liquid from the at least one expanding tube bag depending on a movement direction of the moving member.

2. The ink cartridge of claim 1, wherein the liquid feeding unit comprises:

a bellows coupled to the moving member and storing the liquid; and a liquid transferring pipe for coupling the bellows and the at least one expanding tube bag and communicating the liquid therebetween.

3. The ink cartridge of claim 1, wherein the inflow inlet opening and closing unit further comprises:

an elastic member for elastically pressing the moving member in the first direction so as to expand the at least one expanding tube bag, wherein when the ink cartridge is mounted in the image forming apparatus body, the moving member is moved in the second direction.

4. The ink cartridge of claim 1, wherein the inflow inlet opening and closing unit further comprises:

a pair of rubber covers installed on an inner wall of the inflow inlet to face each other to maintain the closed portion of the inflow inlet.

5. The ink cartridge of claim 4, wherein a pair of expanding tube bags are provided and supported by the pair of rubber covers, respectively.

6. The ink cartridge of claim 5, wherein the inflow inlet opening and closing unit further comprises:

a pair of sealing bags installed on an inner circumference of the inflow inlet to face each other and being positioned between the expanding tube bags to substantially prevent a gap from being generated between a point at which the expanded tube bags contact each other and contact the inner circumference of the inflow inlet.

7. The ink cartridge of claim 1, further comprising:

a sealing member installed in the inflow inlet for sealing between an outer circumference of a drainpipe and an inner circumference of the inflow inlet when the drainpipe is inserted into the inflow inlet.

8. The ink cartridge of claim 7, wherein the sealing member comprises:

a flexible film coupled to the inner circumference of the inflow inlet and comprising a cavity through which the drainpipe passes; and a flexible wire formed at an edge of the flexible film to be thicker than the flexible film.

9. A wet-type electrophotographic image forming apparatus comprising:

an image forming apparatus body comprising a developing unit for forming a predetermined image using ink;

an ink cartridge detachably mounted with respect to the image forming apparatus body and comprising ink to be fed to the developing unit, wherein the ink cartridge comprises:

a housing comprising an inflow inlet to which a drainpipe for withdrawing the ink to the ink cartridge can be coupled; and an inflow inlet opening and closing unit for operating together with the image forming apparatus body such that when the housing is mounted in the image forming apparatus body, a center portion of the inflow inlet is opened and a remaining portion of the inflow inlet remains closed, wherein the inflow inlet opening and closing unit comprises:

a moving member installed in the housing so as to move in first and second directions, wherein the moving member is configured to move in the second direction when the ink cartridge is being mounted in the image forming apparatus body;

an elastic member for elastically pressing the moving member in the first direction;

at least one expanding tube bag installed in the inflow inlet for expanding and shrinking depending on an inflow amount of liquid to close and open the inflow inlet, respectively; and a liquid feeding unit for selectively feeding the liquid to and withdrawing the liquid from the at least one expanding tube bag depending on a movement direction of the moving member.

10. The wet-type electrophotographic image forming apparatus of claim 9 wherein:

the at least one expanding tube bag expands when receiving liquid from the liquid feeding unit as the moving member moves in the first direction, and shrinks when returning liquid to the liquid feeding unit as the moving member moves in the second direction.

* * * * *